United States Patent [19]

Bassi et al.

[11] 4,280,460

[45] Jul. 28, 1981

[54] AUTOMATIC REGULATOR OF THE IDLING IN AN INTERNAL-COMBUSTION ENGINE

[75] Inventors: Aldo Bassi, Milan; Dario Radaelli, Legnano; Edoardo Rogora, Milan, all of Italy

[73] Assignee: Alfa Romeo S.p.A., Milan, Italy

[21] Appl. No.: 968,421

[22] Filed: Dec. 11, 1978

[30] Foreign Application Priority Data

Dec. 22, 1977 [IT] Italy ..... 31150 A/77

[51] Int. Cl.[3] ..... F02D 11/08

[52] U.S. Cl. ..... 123/382; 123/349

[58] Field of Search ..... 123/103 R, 102, 97 R, 123/140 J; 180/175, 176, 177

[56] References Cited

U.S. PATENT DOCUMENTS

| | | | |
|---|---|---|---|
| 3,253,772 | 5/1966 | Parker | 123/103 R |
| 3,659,499 | 5/1972 | Woodward | 123/103 R |
| 3,861,490 | 1/1975 | Sakakibara | 123/103 R |
| 3,921,751 | 11/1975 | Sakakibara et al. | 123/103 R |
| 3,964,457 | 6/1976 | Coscia | 123/32 EA |
| 4,133,408 | 1/1979 | Riddel | 123/103 R |

*Primary Examiner*—P. S. Lall

*Attorney, Agent, or Firm*—Charles E. Brown

[57] ABSTRACT

For the automatic adjustment of the number of revolutions per minute of an internal combustion engine in idling conditions when the accelerator pedal is released, a device is disclosed with which the instantaneous rpm is sensed and compared with reference values of the number of revolutions, called $N_1$, $N_2$ and $N_3$, wherein $N_2$ is smaller than $N_3$ but equal to, or greater than, $N_1$. These reference values can be used to preset an electronic comparison circuit, or the comparison can be effected by exploiting a mechanism comprising a metering pump, the result being always that when the rpm of the engine is below the preselected minimum, the feed of fuel to the engine is supplemented, whereas it is reduced or cut off if the situation is the contrary, that is when the engine tends to overtake the normal idling rpm.

2 Claims, 1 Drawing Figure

AUTOMATIC REGULATOR OF THE IDLING IN AN INTERNAL-COMBUSTION ENGINE

Figure 1:
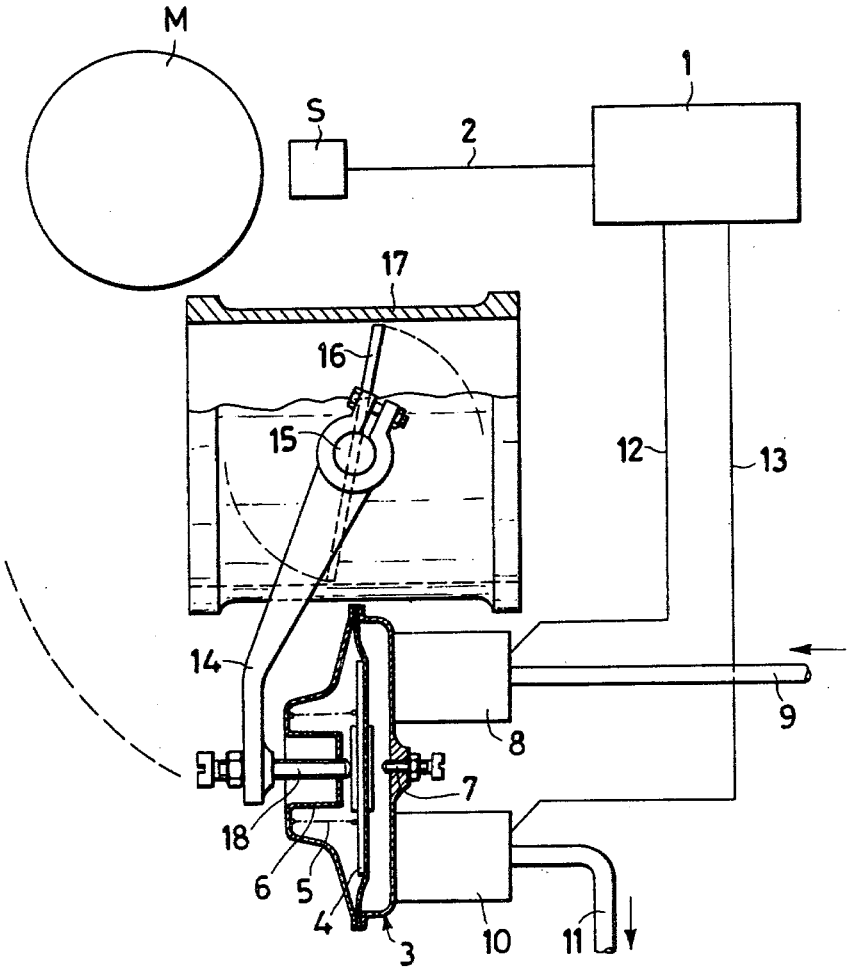

It is known that in the idling run of an internal combustion engine, that is to say, in the specific case of a motor vehicle engine, with the gear in neutral position and with the accelerator pedal released, the number of revolution is a function, on the one hand, of the cross-sectional passageways of air or the mixture drawn in by the engine, and, on the other hand, of the particular situation in which the engine is. This situation, in its turn, is a function of the functional efficiency of the engine, that is, its capacity of converting into mechanical power the thermal power of the fuel which burns in the air which is introduced through said passageways. It is, moreover, a function of the mechanical power which is required for setting the engine into motion. The mechanical power evolved by the combustion is, for the same efficiency, variable with the amount of the mixture which is processed, and thus with the number of revolutions and also the mechanical power required for driving the engine into motion varies as a function of the number of revolutions. The result is that the rpm of the engine in idling conditions is the one in correspodence with which the two powers aforesaid are equal. It is likewise known that in the life of an engine, starting from a new engine as assembled in an assembling lines, that is both in the possible tests of breaking-in on a test bench or on the car, and during the entire normal use of the vehicle on the road, variations are experienced in the mechanical power delivered by the combustion and especially in the mechanical power required for driving the engine to rotation.

The variation of the former can be, for example, a result of variations of the degree of sealtightness of the valves and piston rings, the presence of deposits in the chambers and others, while the variations of the latter (related to the operation) are a result of the characteristics of the contact surfaces of the component parts which are in sliding contact with one another, such as cylinder barrels, pistons, piston rings, bearings and others.

For this number of reasons, the idling rpm would vary considerably in the engine service life if the engine should not be fitted with manual adjustment devices which permit occasionally to modify, during the engine service life, the cross-sectional passageways for air or the mixture for the idling operation, so as to adapt them to the engine situation which is occasionally variable as aforesaid and to bring the rpm of the engine to the preselected idling value. The latter, as is known, is the one which is fairly high and at which the operation is sufficently stable without risk of spontaneous stop, but it is concurrently fairly low so as to have an operation which is cheap, not too noisy, not too polluting for the environment and otherwise. This necessity of systematic actions of adjustment is of course fairly expensive, and involves a trouble for the vehicle driver, but also involves the risk that the adjustment might be made by unskilled operators in an irregular way or with poor care, the results being often negative also from the point of view of the environmental pollution.

It is for preventing the necessity of manual adjustment operations (with the drawbacks enumerated above) that the device of this invention has been envisaged: this is an automatic regulator of the idling, no-load operation of an internal combustion engine, that is, of the minimum angle of opening of the throttling butterfly actuated by the accelerator pedal.

Such a regulator is essentially characterized in that it comprises a movable member which confines at least one volume, it comprises devices adapted to cause the intake into such a volume of a fluid under a preselected pressure and adapted to cause the outflow of such fluid from said volume, the displacements of such movable member corresponding to said intake and outlet of the fluid, said movable member having, operatively connected therewith, abutment means integral with the butterfly so that, when the accelerator pedal is released, the position of said movable member defines the position of minimum opening of the butterfly, said regulator further comprising means responsive to the rpm of the engine and being operatively connected to actuating means adapted to command, when the accelerator pedal is released, said devices in order to have the fluid entering under a preselected pressure into said volume to displace said movable member in the sense of increasing the engine rpm when the rpm is below a first preselected value and to command such devices so as to have the fluid exiting said volume for displacing the movable member in the sense of decreasing the engine rpm when such rpm is above a second preselected value contained in an interval above said first value.

What has been said in the foregoing can better be understood from the drawing in which a preferred embodiment of the device according to this invention is diagrammatically shown.

In the drawing, the numeral 1 indicates a block comprising an electronic circuit to which are directed, through the line 2, electric signals representative of the engine rpm. These electric signals are delivered by a conventional device which is, for example, an electric sensor S, of the inductive type, photo-cell type and the like, which delivers an electric signal whenever a point of discontinuity passes near it, or, at any rate, an energizing member solid with the wheel M, the latter being rotated at a speed proportional to that of the engine shaft. The signals which are a function of the engine rpm could also be taken from the engine ignition system.

At 3 there is indicated a capsule defining a volume, and at 4 a movable wall of the capsule which delimits such volume, 5 is a bias spring which is preloaded and is active upon the outer surface, relative to the volume of capsule 3, of the movable wall 4. In the example shown and described herein, reference is had to a movable-wall capsule in which the actuating fluid is a liquid, such as gasoline or a lubricating oil, under a pressure exceeding atmospheric pressure, but a gaseous fluid which has a negative pressure relative to the ambient pressure could as well be used and in this case the bias spring should be located on the inner surface of the movable wall 4. At 6 and 7 there are indicated two end-of-stroke abutments for limiting the displacements of the movable wall 4 perpendicular to its surface, said abutments being possibly position-adjustable. 8 and 10 are two electromagnetic valves. Valve 8 is inserted between the capsule 3 and a duct 9, which duct receives gasoline under pressure as delivered by the gasoline-feeding pump of the engine. Valve 10 is inserted between the capsule 3 and a duct 11 through which duct gasoline can be fed back to the tank or to the suction side of the gasoline feeding pump. Said pump and the tank are not shown in the drawings. 12 and 13 are electric leads which connect the electronic circuit of block 1 with the electromagnetic valves 8 and 10, respectively. Through the leads 12 and 13 the electricity which is necessary to actuate the electromagnetic valves 8 and 10 is caused to flow. The electronic circuit is so arranged as to compare with reference values such as $N_1$, $N_2$ and $N_3$ of the signals which are a function of the engine rpm and reach the electronic circuit through the lead 2, and to send current for opening the electromagnetic valve 8 whenever, on the basis of such signals, the engine rpm is below a preselected value $N_3$ and also below a preselected value $N_1$, the $N_1$ being less than $N_3$. Conversely, current is sent to open the electromagnetic valve 10 when the engine rpm is below $N_3$ but above $N_2$, the value $N_2$ being less than $N_3$ but greater than, or equal to, $N_1$. As a result, in the first case, through the electromagnetic valve 8, liquid is allowed to enter the capsule 3 and shifts the movable wall 4 in a direction, that is, in the sense of opening the throttle 16 to increase the engine rpm until the rpm itself takes a value between $N_1$ and $N_2$, whereafter the electronic circuit of the block 1 cuts off the opening command to the electromagnetic valve 8. In the second case, conversely, the liquid exits, through the electromagnetic valve 10, from the capsule 3 and the movable wall 4 is shifted in the opposite direction, that is, in the sense of closing the throttle 16 so as to decrease the engine rpm until it takes a value comprised between $N_2$ and $N_1$, whereafter the electronic circuit of the block 1 cuts off the opening command to the electromagnetic valve 10. Lastly, in the drawing, the numeral 14 indicates a lever integral with the arbor 15 of the throttle butterfly 16, which, arranged in the intake duct 17 of the engine, is controlled so as to throttle the air or the feed mixture to the engine itself. When the accelerator pedal is released, a spring, as is known, rotates the throttle so as to bring same to the maximum closure position (the accelerator and the spring are not shown in the drawing) since the end of the lever 14 has fastened thereto an adjustable thimble 18 which, in this position of the throttle, abuts with its tip the center of the movable wall 4, so that the position of such movable wall defines the end-of-stroke position of the throttle and thus its degree of closure and the device described hereinabove acts in such a way that the rpm of the engine in idling conditions may lie within a comparatively narrow value range, i.e. between $N_1$ and $N_2$ and this occurs irrespective of the more or less great efficiency of the engine, its conditions of breaking-in and possibly also of the engine temperature and the oil temperature when the engine and the oil have not reached their steady run conditions.

It has been experienced that in order to have a smoother engine run when the accelerator pedal is released with an rpm higher than $N_3$ and thus when the electronic circuit of the block 1 does not command the opening of the electromagnetic valves 8 and 10, a very narrow passageway port 9' can be arranged in parallel with the electromagnetic valve 8 between the duct 9 and the capsule 3 so as to keep the capsule 3 full of liquid and to urge the wall 4 against its end-of-stroke abutment 6. The narrow passageway port 9' in parallel with the electromagnetic valve 8 can be provided in the interior of the body of the electromagnetic valve itself.

We claim:

1. An automatic regulator of the idling rpm of an internal combustion engine equipped with at least one throttling butterfly for throttling the feeding of a fluid stream for the engine, said butterfly being actuated as a function of the position of the accelerator pedal, said regulator being characterized in that it comprises a volume provided with a movable wall, first and second electrically controlled normally closed valve means for causing the delivery of a pressurized fluid into said volume and, respectively, the outflow of such fluid from said volume with displacements of said movable wall corresponding to said supply and outflow of the pressurized fluid, said throttling valve having integrally formed therewith abutment means capable of engaging with said movable wall when the accelerator pedal is released so as to define the position of minimum opening of the butterfly and therefore the throttling of the engine in its idling operation, said regulator further comprising sensing means for sensing engine rpm and being connected to processing means of an electronic circuit for comparing an engine rpm signal coming from said sensing means with a reference signal corresponding to a preselected rpm value lower than a threshold value, said electronic circuit being operable to deliver first electric control signals to said first valve means for supplying pressurized fluid into said volume in order to increase the engine rpm in idling condition when the engine rpm is lower than said preselected value and being operable to deliver second electric control signals to said second valve means for outflow of pressurized fluid from said volume in order to decrease the engine rpm in idling condition when the engine rpm is higher than said preselected value and lower than said threshold value.

2. A regulator according to claim 1, wherein said electronic circuit is operable to compare the engine rpm signal with reference signals corresponding to said preselected value and to a further preselected value higher than the first preselected value and lower than said threshold value, said electronic circuit being operable to deliver first electric control signals to said first valve means for supplying pressurized fluid into said volume in order to increase the engine rpm in idling condition when the engine rpm is lower than said first mentioned preselected value and being operable to deliver second electric control signals to said second valve means for outflow of pressurized fluid from said volume in order to decrease the engine rpm when the engine rpm is higher than said further preselected value and lower than said threshold value.

* * * * *